United States Patent [19]

Withers et al.

[11] 4,385,454

[45] May 31, 1983

[54] INSULATION BLANKET AND BAND CLAMPS

[75] Inventors: Jean D. Withers, Auburn; Carlo Fineo, Austell, both of Ga.; L. Andrew Withers, Jr., 5801 Whispering Pines, Mableton, Ga. 30059; Leland A. Withers, Sr., 1706 Greenbrook Dr., SW., Austell, Ga. 30001

[73] Assignees: Leland A. Withers, Sr.; L. Andrew Withers, Jr., both of Austell, Ga.

[21] Appl. No.: 307,735

[22] Filed: Oct. 2, 1981

Related U.S. Application Data

[63] Continuation-in-part of Ser. No. 258,324, Apr. 28, 1981.

[51] Int. Cl.[3] ..... F26B 13/08; F26B 25/20

[52] U.S. Cl. ..... 34/110; 34/124; 165/89; 411/85; 411/95

[58] Field of Search ..... 34/110, 124; 165/89, 165/146, 185; 432/10, 60, 253, 255.1; 411/85, 86, 87, 90, 95, 99

[56] References Cited

U.S. PATENT DOCUMENTS 4,241,518 12/1980 Alexy ..... 34/110

FOREIGN PATENT DOCUMENTS 509092 1/1931 Fed. Rep. of Germany ..... 411/87

*Primary Examiner*—Larry I. Schwartz

*Attorney, Agent, or Firm*—Thomas & Kennedy

[57] ABSTRACT

A lightweight pliable heat and noise insulator blanket is mounted to the exterior surface of the axial end wall of a temperature controlled cylinder with band clamps that grasp adjacent ones of the connector screws that hold the end panel to the cylinder. The insulator blanket comprises multiple layers of heat and noise insulation material, and the blanket defines a central opening and a slot extending from the central opening through the outer peripheral edge portion so that the blanket can be positioned about the axle of the rotary cylinder. The band clamps each include a band formed in a closed shape for positioning about adjacent ones of the connector screws of the rotary cylinder, and a mounting block positioned between the connector screws.

9 Claims, 7 Drawing Figures

INSULATION BLANKET AND BAND CLAMPS

CROSS REFERENCE TO RELATED APPLICATION

This is a continuation-in-part of U.S. patent application Ser. No. 258,324, filed Apr. 28, 1981.

BACKGROUND OF THE INVENTION

This invention relates to thermal and noise insulation of the axial end walls of heated or cooled temperature controlled rotary cylinders, as for example the type of rotatable cylinders used in the paper manufacturing industry, and more particularly to the mounting of the insulation blanket to the cylinder end wall.

In the process of manufacturing paper products, wet paper is moved in a web about a plurality of heated rotary cylinders, and the heated cylinders progressively dry the paper. The rotary dryer cylinders can be heated from various heat sources, with a common heat source being superheated steam at a temperature sufficient to heat the cylindrical convex surface of the dryer cylinder to the desired temperature, usually between 100° F.-600° F. The steam is transmitted under pressure through the axles of the dryer cylinders to heat the inside of the dryer cylinders.

Since the web of paper makes continuing contact with the external convex surfaces of the dryer cylinder walls during the operation of the dryer cylinders, a major portion of the heat applied to the cylindrical wall of each dryer cylinder is absorbed by and taken away by the paper; however, the web of paper does not contact the axial end walls of the dryer cylinders, and the heat from inside each dryer cylinder that is transferred through its axial end walls is lost to the atmosphere.

Some attempts have been made to insulate the axial end walls of heated dryer cylinders. For example, the prior art discloses mounting a pair of semi-circular rigid insulator panels with clamps to the connector screws of the axial end walls of a dryer cylinder. Supporting a rigid insulator panel in two halves at the end of a rotatable dryer cylinder is believed to be somewhat hazardous since the halves may tend to part under the stress of centrifugal force and fly off of the rotary cylinder. Moreover, the attachment of clamps to single ones of the end wall connector screws is also believed to be hazardous because the clamps may fail.

While it appears that external heat shields can be applied to the external surfaces of a rotatable dryer cylinder by mounting the heat shields to the connector screws that attach the axial end walls to the cylindrical wall of the dryer cylinder, the connector screws must contain the axial end walls in position against the force of the high pressure super-heated steam within the dryer cylinder, and the loosening or otherwise adjusting of the connector screws might result in a safety hazard due to the connector screws parting from the dryer cylinder during rotation or due to steam leakage between the cylindrical wall and the axial end wall of the dryer cylinder. Additionally, many of the dryer cylinders which contain fluid under pressure are regulated by ASME pressure vessel codes. Therefore, the connectors used to mount insulators to the end walls of heated dryer cylinders must not alter the position of the connector screws or otherwise modify the ability of the connector screws to function in accordance with their specifications.

SUMMARY OF THE INVENTION

Briefly described, the present invention comprises a lightweight pliable heat and noise insulator assembly for the axial end wall of a paper machine rotary dryer cylinder, or for a similar heated or cooled cylindrical structure, which includes an annular, one piece flexible insulation blanket that defines a central opening and an approximately circular outer periphery and a split or slot extending from the inner opening to the outer periphery, whereby the one piece insulator blanket assembly can be positioned about the axle of a rotatable dryer cylinder and positioned in abutment with the axial end wall of the dryer cylinder when the cylinder is in its plant operating configuration. Band clamps are used in combination with the insulator assembly and each band clamp includes a metal band in a closed shape that extends about adjacent ones of the connector screws of the dryer cylinder and a mounting block within the confines of the band to be located between the connector screws. The spans of the band extending between the dryer cylinder connector screws are drawn together by a bolt so as to draw the band tightly about the connector screws. The insulator blanket is mounted to the band clamps by inserting screws, etc., through grommets or other elements of the insulator blanket and attaching the screws to the mounting blocks of the band clamps.

Thus, it is an object of the present invention to provide a flexible, lightweight, durable insulator assembly for mounting to the exterior surface of the axial end wall of a temperature controlled rotary cylinder such as a heated dryer cylinder for a paper making process, without modifying or changing the positions of the connector screws extending from the axial end walls of the dryer cylinder.

Another object of this invention is to provide a combination of an insulator and a band clamp which can be expediently mounted to the axial end wall of a temperature controlled rotary cylinder.

Other objects, features and advantages of the present invention will become apparent upon reading the following specification, when taken in conjunction with the accompanying drawings.

DETAILED DESCRIPTION

Figure 1:
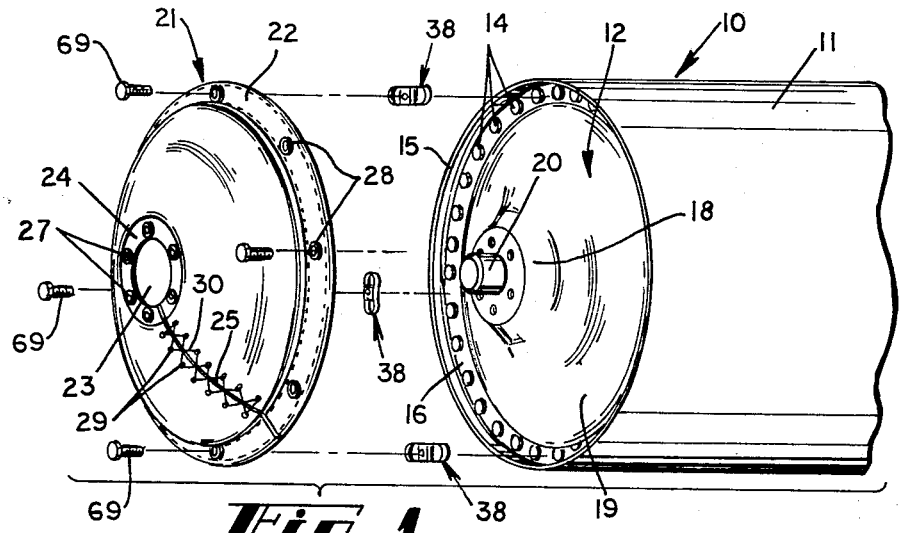
FIG. 1 is a perspective illustration of an axial end wall and a portion of a cylindrical wall of a rotary dryer cylinder, and shows the end panel insulator assembly and its connectors exploded away from the dryer cylinder.

Referring now in more detail to the drawings, in which like numerals indicate like parts throughout the several views, FIG. 1 illustrates a rotatable heated dryer cylinder 10 having an outer annular wall 11 and axial end walls such as end wall 12 at opposite ends of the annular wall. The end walls 12 are rigidly mounted to the annular wall 11 by a plurality of connector screws 14 which are arranged in an annular array adjacent the peripheral edge of the end wall 12. The end of the dryer cylinder that is illustrated in the drawing includes an annular overhang 15, whereby the annular wall 11 extends beyond the axial end wall 12; however, the other end of the dryer cylinder may be shaped somewhat differently. The end wall 12 illustrated in FIG. 1 also includes an annular flattened face 16 at its outer periphery, an inner protrusion 18 at its center, and an intermediate annular dished or concave face 19. Journal 20 extends centrally from the inner protrusion 18. Some dryer cylinders have end walls that are shaped differently. For example, some end walls have an intermediate annular surface that is convex.

A one piece flexible insulator blanket assembly 21 is sized and shaped to fit against the axial end wall 12 of the dryer cylinder, inside the annular flange 15. Insulator blanket assembly 21 includes an outer, annular peripheral portion 22, a central opening 23 bordered by an inner annular peripheral portion 24, and a radially extending slot 25 which extends from central opening 23 radially outwardly through the outer annular peripheral portion 22. The inner opening 23 is sized to fit about the inner protrusion 18 of the dryer cylinder end wall. A plurality of grommets 27 are formed in the inner annular peripheral portion 24, a second plurality of grommets 28 are formed in the outer annular peripheral portion 22 of the insulator blanket assembly, and a third plurality of grommets 29 are formed on opposite sides of the radially extending slot 25. A cord 30 is laced through the grommets 29 to hold the slot 25 closed.

The outer and inner annular peripheral portions 22 and 24 of the insulator blanket assembly 21 is reinforced by a band of material such as band 31 (FIG. 2) stitched to opposite sides of the outer peripheral portion of the insulator blanket assembly. The insulator blanket assembly comprises multiple layers of heat insulation material such as rock wool or fiber glass or Nomex mat 32, with an outer durable, substantially heat resistant cover 34 extending thereover such as silicon, Nomex, Hyperlon, Teflon, Kevlar or Viton sheet material. The bands of material 31 which extend about the outer and inner peripheries of the blanket material are formed from Viton or silicon or Nomex sheet material and overlap the blanket material on opposite sides of the blanket material, and the bands are stitched to the blanket material with rows of stitching 35. The grommets 28 are attached to the blanket assembly and form openings through the outer and inner peripheral portions 22 and 24 of the blanket assembly. The grommets 28 and stitching 35 and band of material 31 extending about the outer periphery of the blanket assembly tend to reinforce and stiffen the outer peripheral portion of the blanket assembly. The material for the outer and inner bands is selected from materials such as Viton or silicon sheet material and the bands provide high heat resistance, abrasion resistance and stiffness to both the front face and the back face of both the inner and outer peripheral edges of the blanket assembly.

Figure 2:
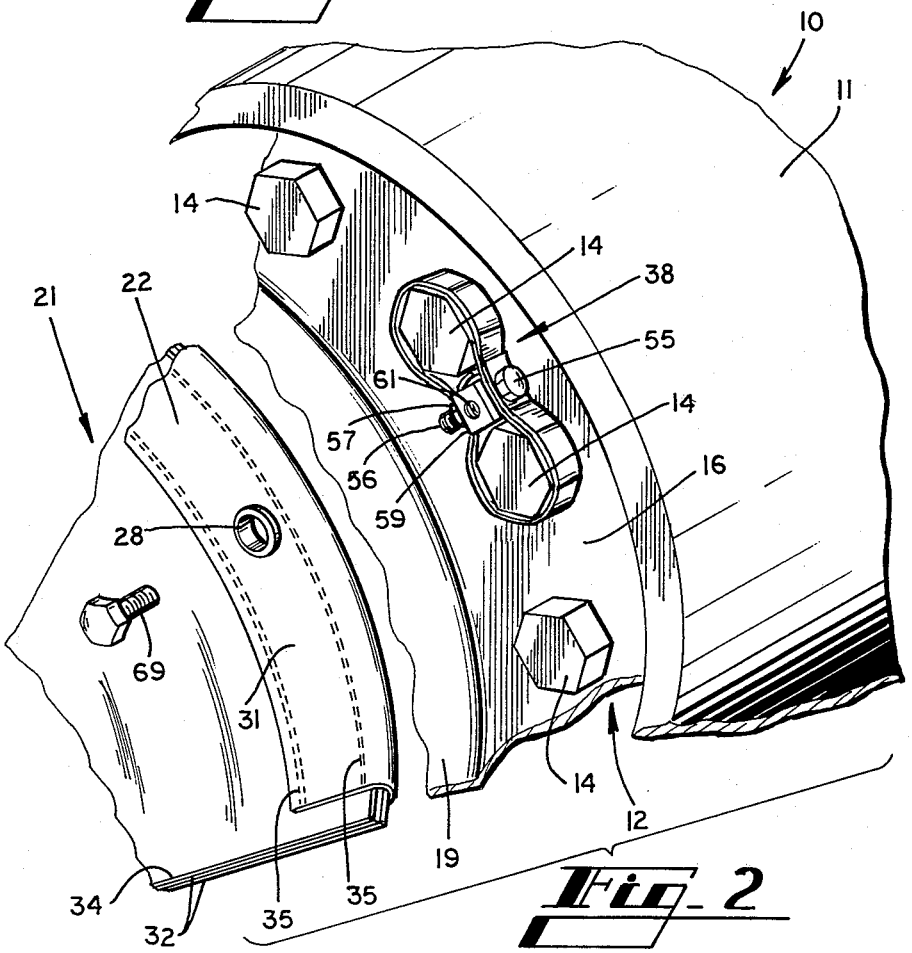
FIG. 2 is a perspective detail illustration of a portion of the axial end wall and the cylindrical wall of a rotary dryer cylinder, and of the end panel insulator, with a connector mounted to adjacent ones of the connector screws of the rotary cylinder, and with the insulator blanket exploded away from the rotary cylinder.
Figure 3:
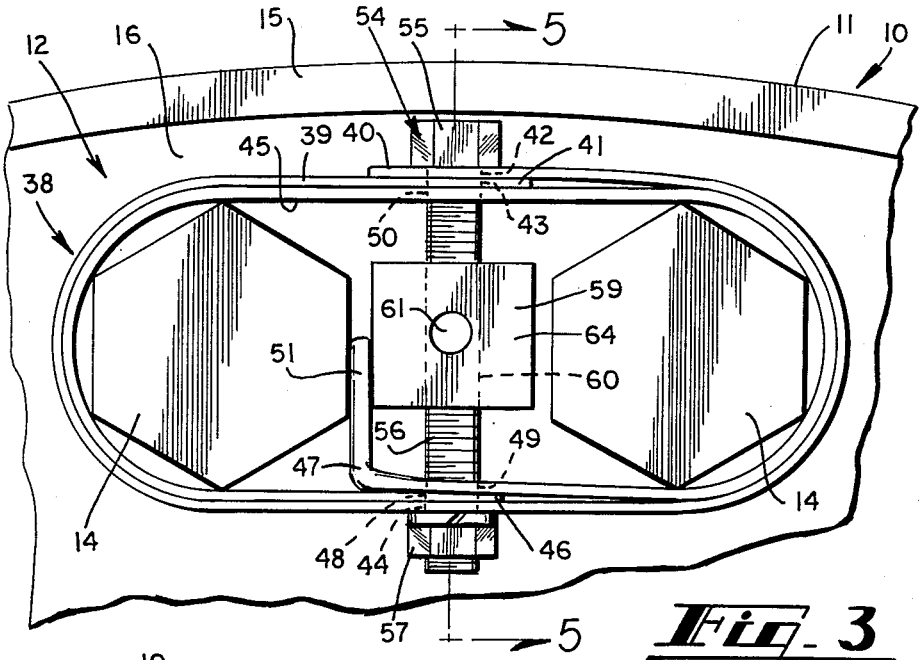
FIG. 3 is a side elevational view of the connector, showing the connector loosely applied about adjacent ones of the heads of the connector screws of the rotary cylinder.
Figure 4:
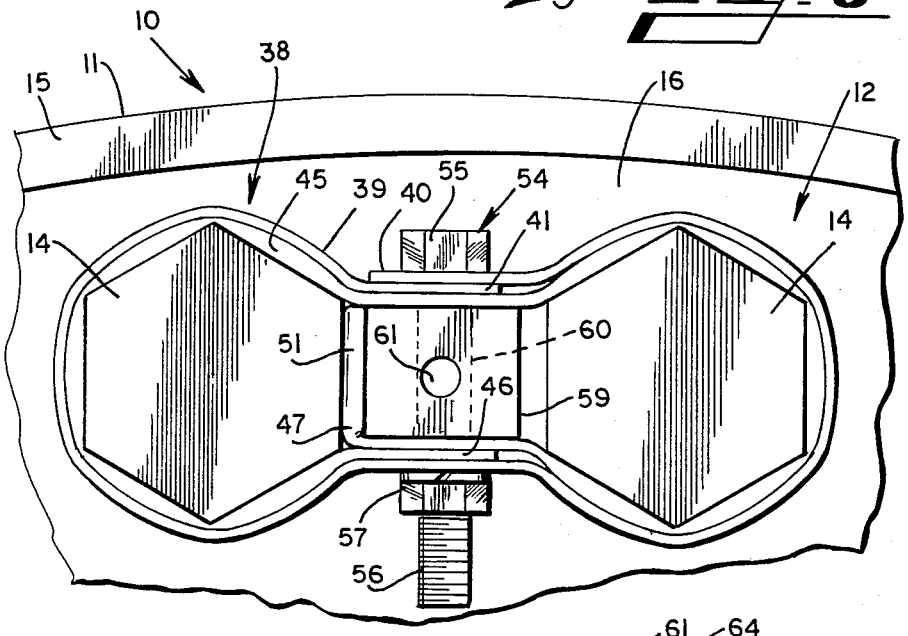
FIG. 4 is a side elevational view of the connector of FIG. 3, but showing the bands tightened about the heads of the connector screws of the rotary cylinder.

As is best illustrated in FIGS. 2, 3 and 4, connectors 38 are mounted to the heads of the adjacent ones of the connector screws 14 of the dryer cylinder. Connectors 38 each comprise a band clamp which includes a band 39 formed in a closed shape with overlapping end portions 40 and 41, with the band being of sufficient length to extend about adjacent ones of the connector screws 14. Band 39 is fabricated from strip steel which generally is cold rolled low carbon tempered strip steel, or spring steel, and openings 42 and 43 are formed in the overlapping end portions 40 and 41 of the band. A similar opening 44 is formed through the band diametrically across from openings 42 and 43.

An additional inner band 45 overlies the outer band 39, and has overlapping end portions 46 and 47. The overlapping end portions of inner band 45 are located diametrically across from the overlapping end portions 40 and 41 of the outer band 39. Openings 48 and 49 are formed in the overlapping end portions of inner band 45, and opening 50 is formed through inner band 45 at a position diametrically across from openings 48 and 49. The overlapping portion 47 of inner band 45 includes a tail protrusion 51 for extending between the adjacent connector screws 14.

Tightening bolt 54 includes a screw with a head 55 and a threaded shank 56, and a nut 57. Mounting block 59 includes internally threaded opening 60 which extends therethrough, and an internally threaded bore 61 which extends part way through the mounting block and extends at a right angle with respect to the opening 60. The shank 56 of tightening bolt 54 extends through the aligned openings 42 and 43 of the overlapping end portions of outer band 39, through the opening 50 of inner band 45, is threaded part way through the threaded opening 60 of mounting block 59, and then extends through the openings 48 and 49 of inner band 45 and through opening 44 of outer band 39. Nut 57 is then loosely threaded on the shank 56, so that the mounting block 59 is located intermediate the head 55 and the nut 57 of the tightening bolt 54, with the spans of the outer and inner bands which extend between the positions of the tightening screws 14 displaced away from the mounting block 59.

When the tightening bolt 54 is tightened, as by rotating the nut 57 with respect to the shank 56, the spans of the outer and inner bands are drawn together, from the position illustrated in FIG. 3 to the position illustrated in FIG. 4, so that the outer steel band 39 is drawn tightly about the connector screws 14 of the dryer cylinder. This tends to compress the inner band 45 against the connector screws 14 and form a secure friction fit about the connector screws and prevent the connector from sliding axially of the connector screws. The inner band 45 is formed from silicon or other compressible and deformable heat resistant material, so that the corners of the heads of the connector screws 14 tend to push into the material of the inner band 45 (FIG. 4) as the outer steel band is drawn tightly about the connector screws 14. In the meantime, the location of the mounting block 59 along the length of the shank 56 of the tightening bolt can be controlled by rotating the shank or by rotating the nut 57 as the tightening bolt is tightened. In most instances, it is desirable that the spans of band be moved into abutment with the upper and lower surfaces of the mounting block 59 (as illustrated in FIG. 4). This tends to locate the mounting block centrally between the adjacent connector screws 14 of the dryer cylinder. The opening 60 in mounting block 59 can be formed without threads, if desired, and the spans of the bands 39 and 45 will center the block between the connector screws as illustrated in FIG. 4.

Figure 5:
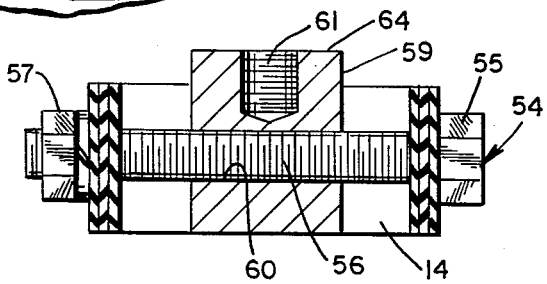
FIG. 5 is an end cross-sectional view of the connector, taken along lines 5—5 of FIG. 3.

As illustrated in FIG. 5, the mounting block 59 is thicker than the heads of the connector screws 14, so that the flat mounting surface 64 extends further away from the axial end wall 12 of the dryer cylinder than the connector screws 14. Moreover, the width of the outer and inner bands 39 and 45 is greater than the thickness of the head of the connector screws 14, so that the bands 39 and 45 protrude outwardly from the axial end wall 12 beyond the connector screws 14 (FIG. 5).

When the band clamps 38 are applied to the connector screws 14 of a dryer cylinder 10, the tightening bolt 54 is relatively loose so that the bands can encircle adjacent connector screws 14, and the tail 51 of the inner compressible band 45 usually is inserted between a connector screw 14 and the mounting block 59. This tends to reduce any vibration that might be encountered between the mounting block 59 and the connector bolts 14.

It will be noted that the mounting block 59 is narrower than the space between adjacent ones of the connector screws 14. Therefore, if a connector should be oriented so that one of its points faces the adjacent connector screw, there will still be enough space to locate the mounting block 59 between the connector screws.

Figure 6:
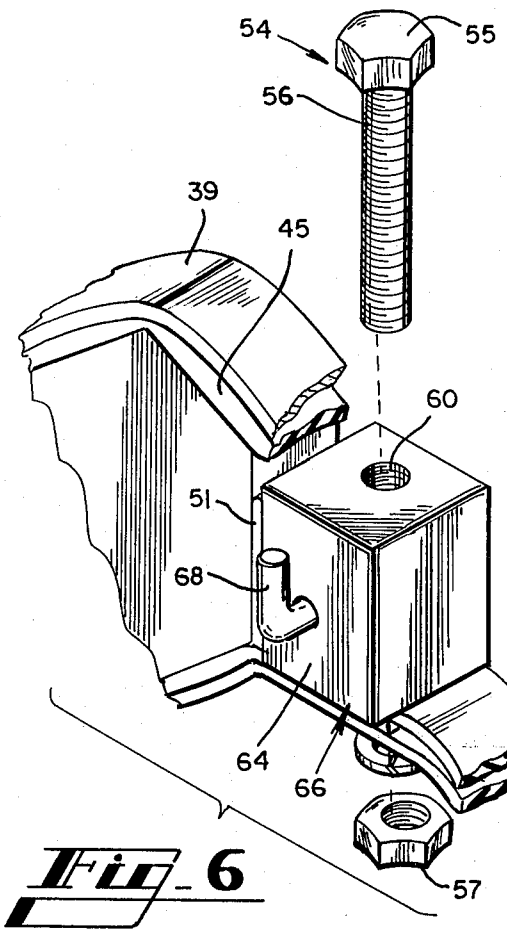
FIG. 6 is a detail perspective illustration, with parts broken away, of a modified mounting block for the connector.

As illustrated in FIG. 6, a modified mounting block 66 can be used, wherein a permanent L-shaped hook 68 protrudes from the mounting surface 64 of the mounting block.

As illustrated in FIG. 2, when the insulator blanket assembly 21 is to be applied to the axial end wall 12 of a dryer cylinder 10, a plurality of connectors 38 are mounted on adjacent ones of the connector screws 14 and tightened, as described above. The insulator blanket assembly 21 is then applied to the end wall 12, by opening the slot 25 of the blanket assembly and inserting the slot about the journal 20, and by aligning the grommets 28 in the outer annular peripheral portion 22 of the insulator blanket assembly with the mounting blocks 59 of the connectors 38. Connector screws 69 are then inserted through the grommets 28 and into the threaded bores 61 of the mounting blocks 59.

Figure 7:
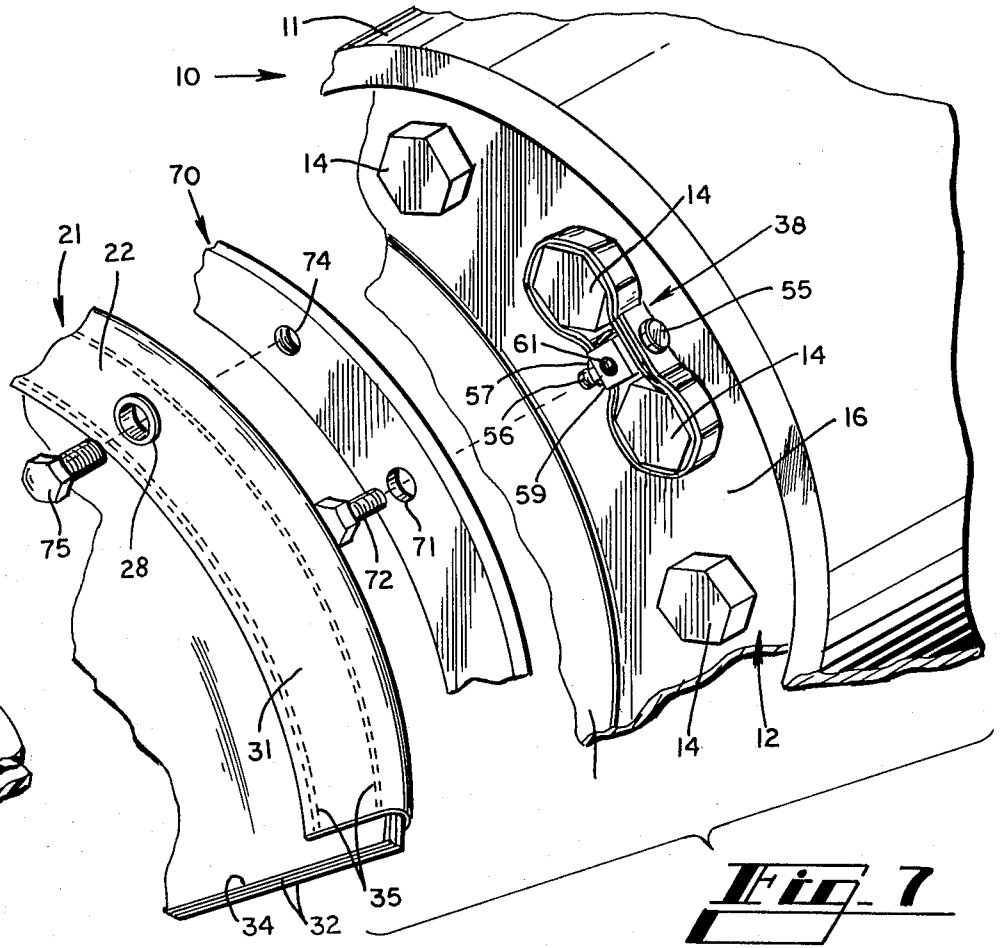
FIG. 7 is a detail perspective illustration of the axial end wall and the cylindrical wall of a dryer cylinder, a mounting ring, and an insulator blanket assembly, with the mounting ring and blanket assembly exploded away from the dryer cylinder.

As illustrated in FIG. 7, an outer mounting ring 70 can be utilized with the assembly, if desired. Outer mounting ring 70 includes ring mount openings 71 which are alignable with the mounting blocks 59 of the connectors 38, and mounting screws 72 extend through the mount openings 71 of the mounting ring 70 and are received in the threads of the mounting block 59. Outer mounting ring 70 also includes internally threaded openings 74 at intervals thereabout, and the insulator blanket assembly 21 is applied to the outer mounting ring 70 by aligning the grommets 28 with the openings 74 and by inserting connector screws 75 through the grommets 28 and into the openings 74.

If an outer mounting ring 70 (FIG. 7) is used as a part of the assembly, only a few connectors 38 are required to hold the rigid mounting ring in place, and a larger number of connector screws 75 can be used to hold the flexible insulator blanket in place. Preferably, the mounting block 59 (FIG. 5) should be thicker than the heads of the connector screws and the bands 39 and 45 also can be wider than the thickness of the heads of the connector screws (FIG. 5) when an outer mounting ring 70 (FIG. 7) is used with the insulator blanket assembly so that the mounting ring 70 is maintained in spaced relationship with the connector screws 14. However, if an outer mounting ring is not used (FIG. 2), it is desirable to use a large number of connectors 38 so that the relatively flexible insulator blanket is held at closely spaced intervals to the end wall of the dryer cylinder. Also, the thickness of the mounting block 59 and the width of the bands 39 and 45 can be reduced so that the outer peripheral edge portion of the insulator blanket is held in abutment with the connector screws 14.

While this invention has been described in detail with particular reference to a preferred embodiment thereof, it will be understood that variations and modifications can be effected within the spirit and scope of the invention as described hereinbefore and as defined in the appended claims.

We claim:

1. In combination, a heat insulation blanket including a circular outer edge with openings extending through the outer edge portion for mounting to the axial end wall of a temperature controlled rotary cylinder of the type including a cylindrical outer surface and at least one axial end wall with a plurality of connector screws in an annular array, and a plurality of blanket mounting means, said blanket mounting means each comprising a band arranged in a closed shape and of a length sufficient to span about adjacent ones of the connector screws of a rotary cylinder end wall, a blanket mounting block supported in the confines of said band, means for drawing the spans of said band extending between the connector screws inwardly toward said mounting block to draw the band tightly about the connector screws, said mounting block defining an internally threaded opening, and a threaded screw for insertion through an opening of said insulation blanket and into the internally threaded opening of a mounting block.

2. The combination of claim 1 and wherein said band of each said blanket mounting means comprises a steel band, and further including a soft compressible band extending between said steel band and the positions of the connector screws of the rotary cylinder about which the steel band is to be located, whereby the compressible band is urged against the connector screws by the tightening of said steel band about the connector screws.

3. The combination of claim 2 and wherein said compressible band of each said blanket mounting means includes a free end of a length sufficient for insertion between said mounting block and the position of a connector screw of the rotary cylinder about which the steel band is to be located.

4. The combination of claim 1 and wherein said mounting block includes an attachment surface against which said heat insulation blanket is supported, said mounting block being sized and shaped to locate its attachment surface a distance away from the end wall of the rotary cylinder which is greater than the distance between the end wall of the rotary cylinder and the outer surfaces of the connector screws of the rotary cylinder end wall, whereby the heat insulation blanket is supported in spaced relationship with respect to the connector screws of the rotary cylinder.

5. The combination of claim 1 and further including an annular mounting ring of a breadth sufficient to span the array of mounting screws of a dryer cylinder, said means for connecting said mounting ring to said blanket mounting means, and for connecting said insulation blanket to said mounting ring.

6. The combination of claim 1 and wherein heat insulating blanket comprises a multiple ply arrangement of heat insulating materials and a peripheral band extending about the outer peripheral portion of said blanket on opposite sides of said blanket, stitching extending through said peripheral band, and grommets mounted to said band, whereby the outer peripheral portion of said blanket is of greater stiffness than the portion of the blanket extending inwardly of said peripheral band.

7. A heat insulation blanket for mounting to the axial end wall of a temperature controlled rotary cylinder of the type including a cylindrical outer surface and an end wall with a plurality of connector screws in an annular array, said blanket including multiple plies of overlying blanket material, said blanket material including an annular outer peripheral edge, a central opening with an annular inner peripheral edge, and a single radial slot extending radially from said central opening through the annular outer peripheral edge, a peripheral band extending about the annular outer peripheral edge of said blanket material and overlapping opposite sides of said blanket material, grommets mounted to said band and forming openings through said band and blanket material, and stitching formed through said band and said blanket material, whereby said blanket material is relatively stiff about is outer peripheral portion, and a plurality of blanket mounting means for connecting the outer peripheral portion of said heat insulation blanket to the end wall of the rotary cylinder at the connector screws of the rotary cylinder.

8. The heat insulation blanket assembly of claim 7 and wherein said blanket mounting means comprises a plurality of band clamps each comprising a band arranged in a closed shape and of a length sufficient to span about adjacent ones of the connector screws of the rotary cylinder, a blanket mounting block supported in the confines of the band, and means for drawing the spans of said band inwardly toward said mounting block to draw the band tightly about the connector screws.

9. In combination, a heat insulation blanket for mounting to the axial end wall of a temperature controlled rotary cylinder of the type including a cylindrical outer surface and at least one axial end wall with a plurality of connector screws in an annular array, and a plurality of blanket mounting means, said blanket mounting means each comprising a band arranged in a closed shape and of a length sufficient to span about adjacent ones of the connector screws of a rotary cylinder end wall, a blanket mounting block supported in the confines of said band, bolt means extending through the spans of said band and through said mounting block for drawing the spans of said band extending between the connector screws inwardly toward said mounting block to draw the band tightly about the connector screws, and means for connecting said blanket to said mounting block.

* * * * *